United States Patent [19]

Hopping, deceased et al.

[11] 4,179,885

[45] Dec. 25, 1979

[54] TURBINE-WHEELED POWER DEVICE

[75] Inventors: Alvin S. Hopping, deceased, late of Lake Hopatcong, N.J., by Clifford A. Johnson, executor, Dover, N.J.

[73] Assignee: Markley D. Fell, Hackettstown, N.J.

[21] Appl. No.: 878,328

[22] Filed: Feb. 16, 1978

[51] Int. Cl.[2] ..... F03G 3/00

[52] U.S. Cl. ..... 60/370; 60/721; 415/90

[58] Field of Search ..... 60/325, 370, 650, 682, 60/721; 415/90

[56] References Cited

U.S. PATENT DOCUMENTS

| | | | |
|---|---|---|---|
| 3,938,337 | 2/1976 | Fawcett | 60/721 X |
| 4,100,743 | 7/1978 | Trumbull et al. | 60/639 |

*Primary Examiner*—Allen M. Ostrager
*Attorney, Agent, or Firm*—Thomas N. Neiman

[57] ABSTRACT

In the embodiment shown, the device comprises a pair of turbine wheels, rotatively journaled, each having a peripheral, concave channel. The wheels are journaled to close onto each other, in close proximity, to define of their channels a circular aperture. A conduit is directed to impel rounds of shot into the aperture, so that rotary torque power will be derived from the turbine wheels. A supply of pressured steam accelerates the rounds through the conduit to the aperture, and a feed wheel singly and successively introduces the shot into the conduit. A drive belt fixed around a hub on the feed wheel and a hub on one of the turbine wheels imparts rotation to the feed wheel, and the spent-missile end of the conduit opens onto the feed wheel to cause the latter to store and advance shot. The turbine wheels are journaled on pivotably mounted limbs so that, selectively, the wheels may be moved into and out of proximity with each other to define of the aperture a more close or more open "nip" for the impinging shot.

10 Claims, 4 Drawing Figures

TURBINE-WHEELED POWER DEVICE

This invention pertains to turbine-wheel power devices, and in particular to such devices operated by missiles impelled by low-cost energized fluids.

The instant invention comprises a refinement or alternative embodiment of my co-pending patent application, Ser. No. 854,148, filed on Nov. 23, 1977, for a "Turbine-Wheel Power Device". In said prior application, I disclose a device which derives energy from missiles impelled by an energized fluid (i.e., steam) by having the missiles impinge on the periphery of a turbine wheel—which turbine wheel is enveloped by a missile-containing shroud.

The energy transfer to be derived from my prior teaching is significant and efficient. However, I have conceived of an improvement or refinement thereof which will realize even further energy transfer. In my prior disclosure, and as just noted, the turbine wheel is enveloped by a shroud which confines the missiles within the device, of course, and into a close-clearance proximity to the periphery of the turbine wheel. Now, as a consequence of this arrangement, in which the accelerated missiles deliver frictional, glancing, energy-transferring impacts to the turbine wheel, they also deflect therefrom and spend some appreciable measure of their energy in the shroud. It is an object of this invention to set forth an improved device which will minimize the amount of energy which is lost, imparting a maximum thereof to turbine wheels disposed in juxtaposition, in which missiles deflecting from a first turbine wheel will impinge on a second one thereof. Particularly it is an object of this invention to set forth a turbine-wheeled power device comprising a plurality of journaled turbine wheels; said turbine wheels of said plurality thereof each having a missile-impingement surface; means disposing said surfaces in juxtaposition; and means for addressing missiles to said surfaces to cause said turbine wheels to rotate.

Further objects of this invention, as well as the novel features thereof, will become more apparent by reference to the following description taken in conjunction with the accompanying figures, in which.

Figures 1, 2, 3, 4:
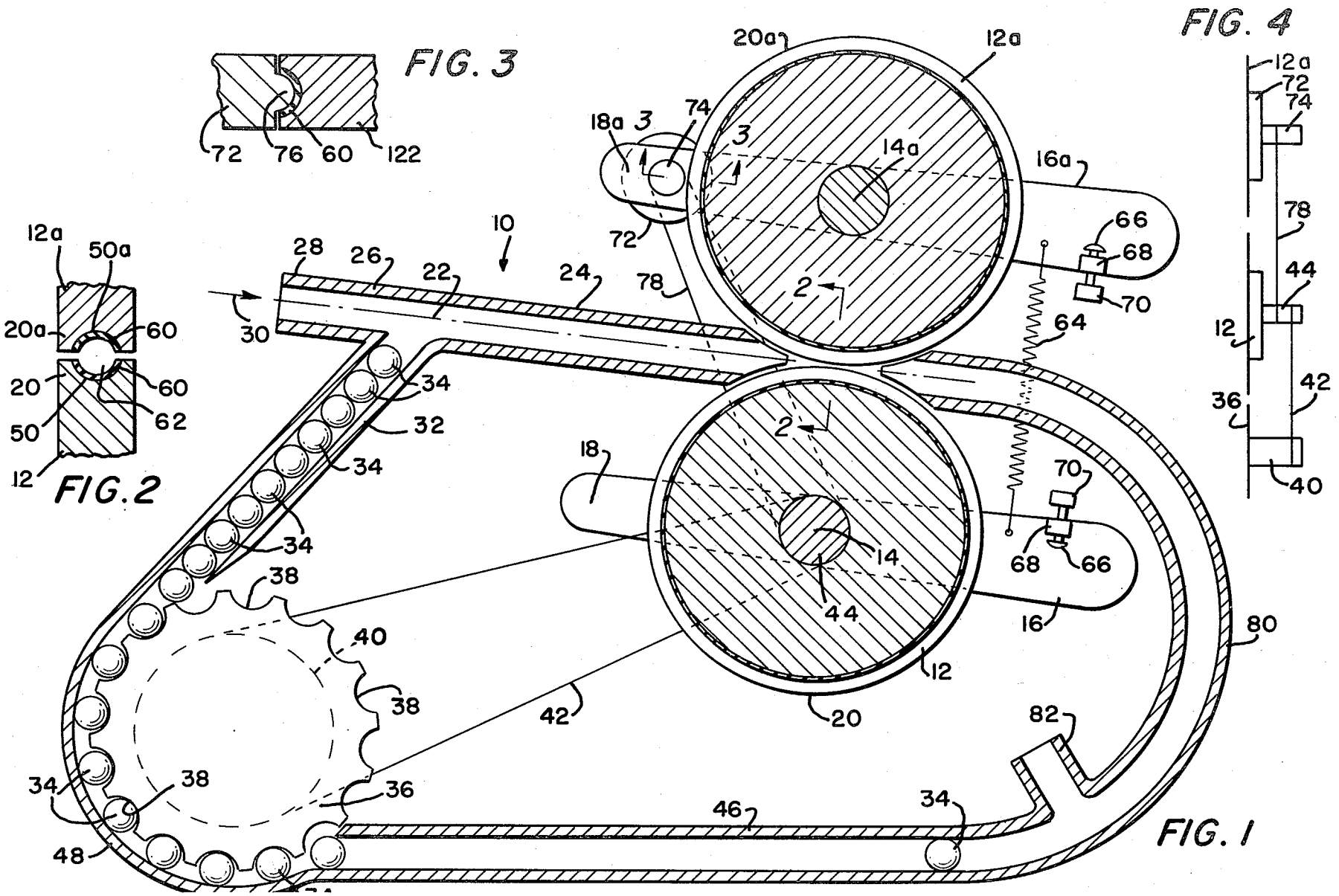
FIG. 1 is a vertical, cross-sectional illustration of an embodiment of the invention.
FIG. 2 is a cross-sectional view taken along section 2—2 of FIG. 1.
FIG. 3 is a cross-sectional view taken along section 3—3 of FIG. 1.
FIG. 4 is a line drawing or schematic which, symbolically, depicts the belt-drive interconnections of several components of the device of FIG. 1.

As shown in the figures, the improved turbine-wheeled power device 10, according to the depicted embodiment, comprises first and second turbine wheels 12 and 12*a* which are rotatively journaled on axes 14 and 14*a*. The wheels are carried on limbs 16 and 16*a* which, in turn, are pivotally supported at 18 and 18*a*. Each wheel has a periphery 20 and 20*a*, and the peripheries close upon each other in near-contacting adjacency to an axis 22. Axis 22 comprises the centerline of a linear portion 24 of a conduit 26 which is directed toward said peripheries. A first end 28 of the conduit is open to a source 30 of steam under pressure for the purpose of impelling missiles toward the turbine wheels 12 and 12*a*.

A pipe 32 opens at one end thereof onto the conduit 26, for supplying missiles 34 thereinto, and opens at the end opposite onto a feed wheel 36. The feed wheel has a plurality of equally spaced recesses 38 formed in the periphery thereof, and a hub 40 on the far side (hidden side) thereof. An endless belt 42 engages hub 40 and a hub 44 formed on the corresponding far side of wheel 12. Hence, rotation of wheel 12 imparts drive to feed wheel 36 and, as a consequence, the other end 46 of conduit 26 supplying energy-spent missiles 34 to the feed wheel, the missiles 34 are charged into the recesses 38. A shroud 48 confines the missiles to the feed wheel 38.

As shown in the cross-sectional view of FIG. 2, the peripheries of wheels 12 and 12*a* have corresponding concave channels 50 and 50*a* which are lined with polytetrafluorethylene strips 60. By this arrangement, the wheels 12 and 12*a*, and their peripheries 20 and 20*a*, cooperatively define an aperture 62 therebetween. Hence, the missiles 34 are singly and successively admitted into the conduit 26 for steam-impelled travel at high velocity toward the aperture 62. There they first impinge upon one or the other of the wheels 12 and 12*a*, to transfer energy thereto, and then deflect therefrom to impinge on the companion wheel to transfer residual energy thereto.

An expansion spring 64 is fixed between the pivotal ends of limbs 16 and 16*a* to urge the limbs toward each other. In addition, adjustment screws 66 carried in limb-mounted, threaded blocks 68 are disposed for contacting engagement with limit stops 70. By selective adjustment of screws 66, then, the "nip" defined by aperture 62 can be altered — to open or close the "nip", so that the missiles' energy-transfer can be made optimum.

An idler wheel 72, having a hub 74, is rotatively journaled on the limb 16*a*; its periphery carries a convex rib 76 — as shown in more detail in FIG. 3. Rib 76 compressively engages the strip 60 carried by wheel 12*a*, and rotary torque is thus transferred between idler wheel 72 and turbine wheel 12*a*. An endless belt 78 is frictionally engaged with hub 74 of the idler wheel and the hub 44 of turbine wheel 12.

In those fractional instants of time, when a missile 34 is impacting on turbine wheel 12*a*, the rotational force induced in the latter is communicated to wheel 12 through the idler wheel 72 and, too, in the alternative, when a missile impacts on turbine wheel 12, the energy transfer is imparted to wheel 12*a* through the idler wheel 72. As a practical matter, the missile impacts occur with such rapid succession that the effect is quite as though wheels 12 and 12*a* were one.

As noted, the energy-spent missiles 34 return to the feed wheel 38; this they do by way of a return bend 80 formed in conduit 26. Bend 80 moves out from the "nip" aperture 62 and turns back toward feed wheel 38, and has a spent steam vent 82 formed therein.

In this novel device 10, a more efficient energy transfer is effected. As soon as the missiles 34 reach the area where linear portion 24 of conduit 26 and the peripheries 20 and 20*a* of the wheels 12 and 12*a* adjoin, they proceed to lose their axial stability. It is more often likely that they will first impinge upon wheel 12 — although it is possible that some may "loft" and impinge upon wheel 12*a* first. However it should occur, they will deflect immediately thereafter to impinge on the companion wheel. Rather than having the energy-transfer arising from the deflected impact absorbed, non-productively, by a shroud or a like, stationary guide, it is taken out in rotary torque from the companion wheel.

It will be self-evident to those skilled in this art, from my teaching herein, that a plurality of such devices 10 can be arrayed in side-by-side disposition, with the rotary torque of a corresponding plurality of turbine wheels 12 coupled, axially, through their hubs 44 to compound the power output for whatever purpose to which the power shall be put. Too, along the lines of my co-pending patent application, it may be deemed more feasible to supplant the feed wheel 36 with a sluice-gate type of missile feed. Such modifications are all deemed to be within the ambit of my invention. Accordingly, while I have described my invention in connection with a specific embodiment thereof, it is to be clearly understood that this is done only by way of example and not as a limitation to the scope of my invention as set forth in the objects thereof and in the appended claims.

I claim:

1. A turbine-wheeled power device, comprising:
a plurality of journaled turbine wheels;
said turbine wheels of said plurality thereof each having a missile-impingement surface;
means disposing said surfaces in juxtaposition; and
means for addressing missiles to said surface to cause said turbine wheels to rotate.

2. A turbine-wheeled power device, according to claim 1, wherein
said missile-addressing means comprises a conduit, means for supplying missiles to said conduit, and means for impelling missiles through said conduit.

3. A turbine-wheeled power device, according to claim 2, wherein:
said missiles-impelling means comprises a source of energized fluid; and
one end of said conduit open onto said energized fluid source.

4. A turbine-wheeled power device, according to claim 3, further including:
means cooperative with said missiles-supplying means for successively and singly admitting missiles into said conduit; wherein
said missiles-supplying means comprises a pipe, said pipe opening at one end thereof onto said conduit;
said cooperative means comprises magazine means for storing and dispensing missiles; and
said pipe opens at the other end thereof onto said magazine means.

5. A turbine-wheeled power device, according to claim 4, wherein:
said magazine means comprises a feed wheel;
said feed wheel being journaled for rotation and having recesses formed in the periphery thereof for nestingly receiving missiles; and
means drivingly coupling said feed wheel to one of said turbine wheels to cause rotation of said feed wheel in common with said one turbine wheel.

6. A turbine-wheeled power device, according to claim 4, wherein:
the opposite end of said conduit opens onto said magazine means;
said conduit has an axis;
said turbine wheels are journaled normal to said axis on journal axes equally spaced apart from said conduit axis; and
said turbine wheels have peripheries which effect proximate, near-contact adjacency at said conduit axis.

7. A turbine-wheeled power device, according to claim 6, wherein:
said peripheries have concave channels formed therein which, in cross-section at said axial, near-contact adjacency, define a circular aperture.

8. A turbine-wheeled power device, according to claim 6, further including:
a pair of limbs;
each of said limbs being pivotally mounted at one end thereof for movement through an arc; and wherein
one of said turbine wheels of said plurality thereof is journaled to one of said limbs;
another of said turbine wheels of said plurality thereof is journaled to the other of said limbs; and
means carried by one of said limbs for imparting rotary torque from one of said turbine wheels to the other thereof and vice versa.

9. A turbine-wheeled power device, according to claim 8, further including:
means intercoupling said limbs for urging said limbs towards each other.

10. A turbine-wheeled power device, according to claim 8, wherein:
said torque-imparting means comprises an idler wheel rotatively journaled on one of said limbs;
said idler wheel having a hub;
one of said turbine wheels having a hub;
a drive belt frictionally engaging both said hubs for transferring rotary torque therebetween; and
said idler wheel having means carried on the periphery thereof for frictionally engaging the periphery of said another turbine wheel.

* * * * *